US005157217A

United States Patent [19]

Feng

[11] Patent Number: 5,157,217

[45] Date of Patent: Oct. 20, 1992

[54] ORNAMENTAL DISPLAY ASSEMBLY HAVING EXTINGUISHABLE LIGHTS

[75] Inventor: I-Pin Feng, Taipei, Taiwan

[73] Assignee: Jack Hou, Taipei, Taiwan

[21] Appl. No.: 581,312

[22] Filed: Sep. 12, 1990

[51] Int. Cl.[5] ..... G10F 1/06

[52] U.S. Cl. ..... 84/95.2

[58] Field of Search ..... 84/95.1, 95.2, 94.1, 84/94.2; 446/238

[56] References Cited

U.S. PATENT DOCUMENTS

| | | | |
|---|---|---|---|
| 2,587,788 | 3/1952 | Tacy | 84/95.2 X |
| 4,890,528 | 1/1990 | Kamijima | 84/95.2 |
| 4,890,828 | 1/1990 | Hou | 446/238 X |
| 5,020,409 | 6/1991 | Hou | 84/95.2 |

*Primary Examiner*—W. B. Perkey
*Assistant Examiner*—Cassandra C. Spyrou
*Attorney, Agent, or Firm*—Bacon & Thomas

[57] ABSTRACT

An ornamental display assembly includes mechanical and electrical displays designed so that the electrical circuit that energizes the electrical display is opened by a mechanical plunger that operates under the influence of the mechanical display drive. A wind-up drive mechanism drives the mechanical display when a dual mechanical/electrical switch is turned to the "on" position to simultaneously energize the electrical display circuit. When the wind-up drive mechanism winds out sufficiently to cause the plunger to extend a desired distance, the plunger forces open an electrical switch to break the electrical circuit, thus extinguishing the electrical display when the mechanical display ceases to operate.

12 Claims, 5 Drawing Sheets

ORNAMENTAL DISPLAY ASSEMBLY HAVING EXTINGUISHABLE LIGHTS

BACKGROUND OF THE INVENTION

1. Field of the Invention

The present invention relates generally to ornamental display assemblies having mechanically movable parts, and, more particularly, to such assemblies including an electrically-operable display that automatically turns off when the mechanical display finishes its operating cycle.

2. Description of the Prior Art

Ornamental display assemblies having mechanically-actuated movable displays have been in existence for centuries. Often, such assemblies include music generators, commonly known as music boxes, for producing music using a relatively simple mechanical system tied to the mechanical system that drives the ornamental display.

Certain of these assemblies further include electrical displays, such as flashing lights or electrically-actuated sound generators, so that the mechanical movements proceed along with a visual or aural display as well. Conventionally, however, ornamental display assemblies of this type must be attended so that, when the mechanical movement ends as the conventional wind-up drive mechanism winds down, the electrical display can be turned off to prevent depleting the typical battery power source. Furthermore, when the electrical display includes any sort of light display, the lights must be turned off so that they do not burn out after the mechanical movement ceases.

SUMMARY OF THE INVENTION

According to the present invention, the above drawbacks are obviated by including means by which the electrical display and the mechanical display are coupled so that, when the mechanical display winds out, the electrical display extinguishes, thereby preventing depletion of the battery and burn out of the electrical devices.

The present invention accomplishes these objectives by assigning a dual function of mechanical switching and electrical switching to the switch normally found in known mechanical ornamental display assemblies. According to the invention, then, when an operator of the ornamental display assembly activates the mechanical assembly by turning the switch to the "on" position, the mechanical switch also closes an electrical switch to energize the electrical display. The known wind-up drive mechanism for driving the mechanical display is situated such that, as the wind-up mechanism expands, it actuates a plunger to mechanically force open a second electrical switch, whereby the electrical display assembly is extinguished when the mechanical display winds out.

BRIEF DESCRIPTION OF THE DRAWINGS

FIG. 3(*b*) is similar to FIG. 3(*a*), but illustrating the opening of the electrical circuit after unwinding of the mechanical drive mechanism, and also the "on" position of the dual mechanical/electrical switch;

FIG. 4(*b*) illustrates the bottom, or reverse, side of a printed circuit board constructed according to the teachings of the present invention;

DETAILED DESCRIPTION OF THE PREFERRED EMBODIMENTS

Figure 1:
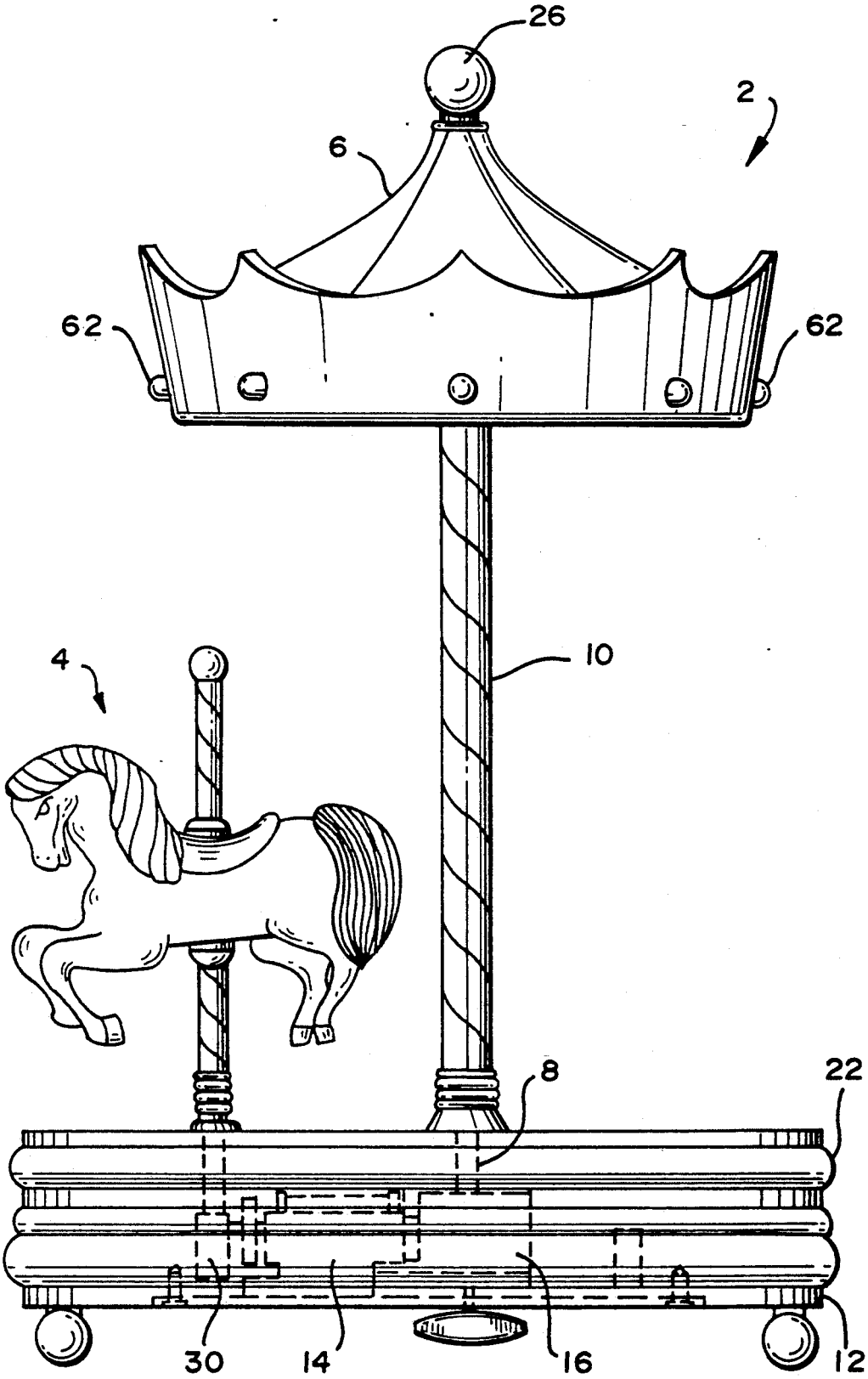
FIG. 1 illustrates a vertical elevational view of an ornamental display assembly constructed according to the present invention.

A preferred embodiment of the present invention is shown in FIG. 1. Illustratively, the present invention includes an ornamental display assembly 2 including an ornament 4, shown as a carousel horse. Additionally, a canopy 6 is shown supported by a support rod 8 and an outer sleeve 10 in a fashion that recalls the overhead canopy of a lifesize carousel. One of ordinary skill in the art will readily recognize that certain of the teachings of the present invention do not rely upon the carousel nature of the ornamental display assembly, but rather may be implemented with ornamental display assemblies of a variety of types.

Figure 2:
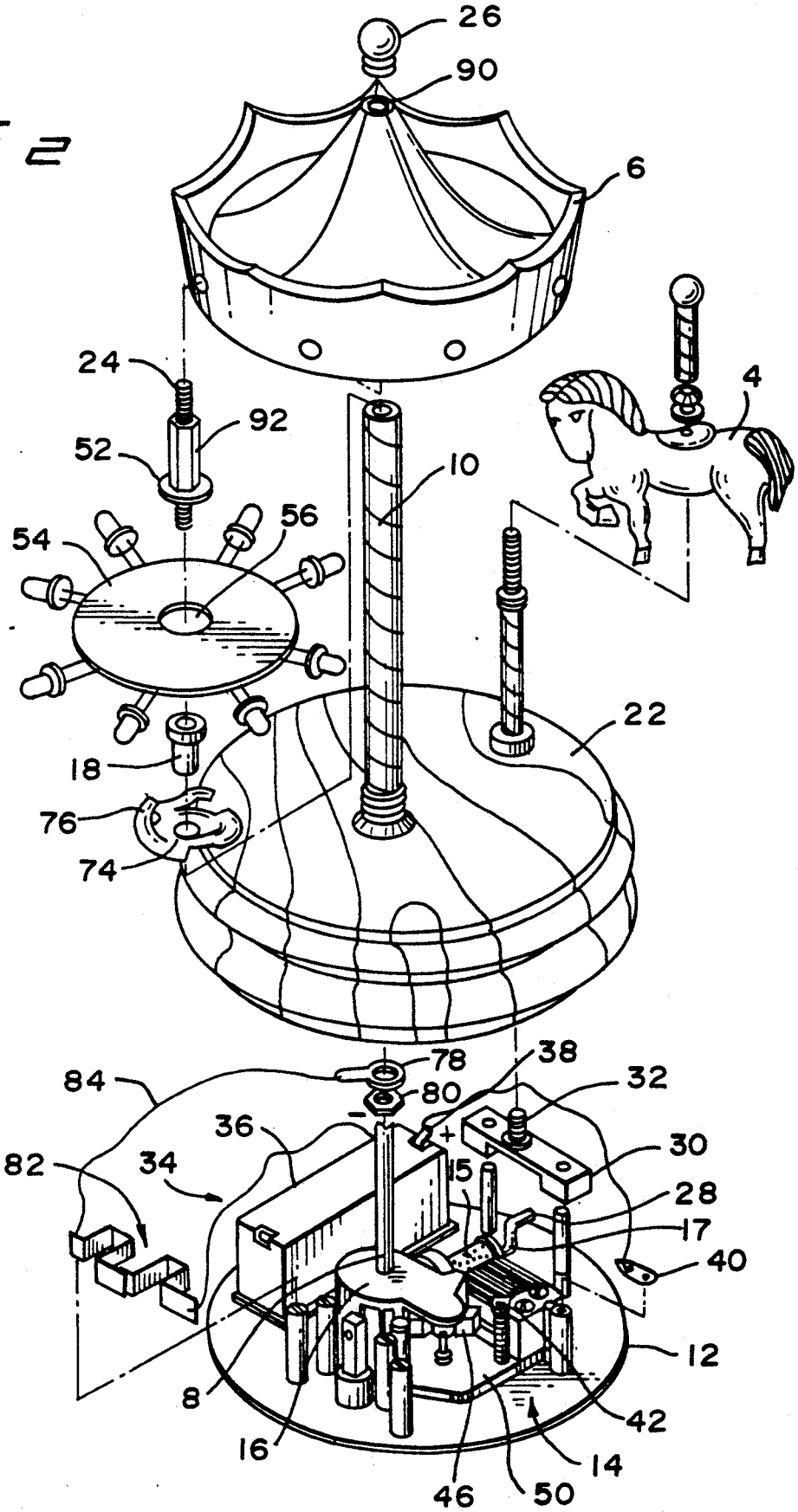
FIG. 2 is an exploded perspective view, illustrating in more detail, of a preferred embodiment of the invention.

Turning to FIG. 2, an exploded schematic of the inventive ornamental display assembly is shown incorporating known music box technology. A base 12 provides support for a music box mechanism, shown generally at 14. An important aspect of music box mechanism 14 to be hereinafter detailed is a wind-up drive mechanism 16, which comprises a coil spring wound by an external crank, and which, when unwinding, drives a first output shaft 17 to a music box drum 15, as well as support rod 8, which is attached to a second, threaded output shaft (not shown) at the top of wind-up drive mechanism 16. Support rod 8 extends coaxially inside outer sleeve 10, which extends upwardly from the center of a base cover 22 up underneath canopy 6, to be secured via a threaded shaft 24 to a spherical cap 26. As shown, shaft 24 is threaded at both ends to threadedly engage support rod 8 at one end, and spherical cap 26 at the other end. Support rod 8 is electrically insulated from sleeve 10 by an insulator plug 18.

Ornament 4 is illustratively shown as a carousel horse, as in FIG. 1, and is arranged to move vertically in response to the rotation of first output shaft 17 of wind-up drive mechanism 16. As shown in FIG. 2, first output shaft 17 includes an offset end 28 designed to act as a camming member for raising and lowering a base 30, which supports a threaded shaft 32 connected to ornament 4 in a known manner, for example as shown in Hou U.S. Pat. No. 4,890,828, the teachings of which are hereby incorporated by reference. By this design, ornament 4 is raised and lowered during operation of the ornamental display assembly.

As previously mentioned, wind-up drive mechanism 16 includes a second output shaft, not shown in FIG. 2, for rotating canopy 6 via support rod 8. The second output shaft is a threaded shaft protruding substantially vertically from the housing of wind-up drive mechanism 16. The respective threads of the second output shaft and support rod 8, therefore, should be designed in an opposite sense to the rotation of the second output shaft so that operation of the wind-up drive mechanism does not encourage disengagement of support rod 8 from the second output shaft. When wind-up drive mechanism 16 is operational, then, support rod 8 rotates to thereby rotate canopy 6 in similar fashion to lifesize carousels. The canopy drive of the invention is described in more detail in Hou U.S. Pat. No. 4,890,828, the teachings of which have been incorporated by reference.

Figure 3A:
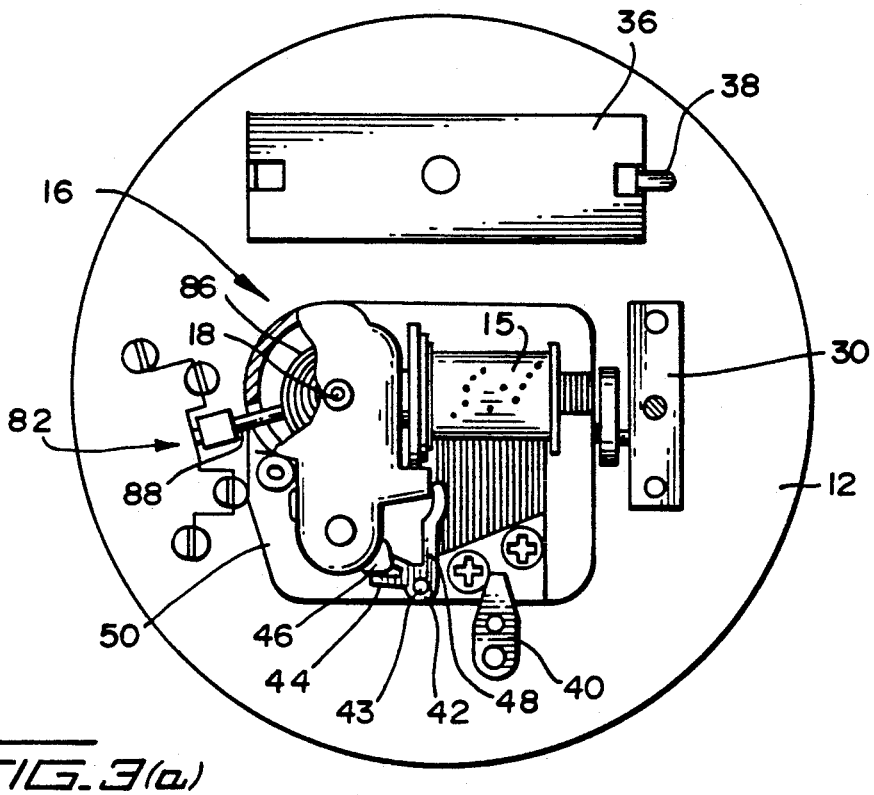
FIG. 3(*a*) is a top plan view, partly in section, illustrating the "off" position of the dual mechanical/electrical switch.
Figure 3B:
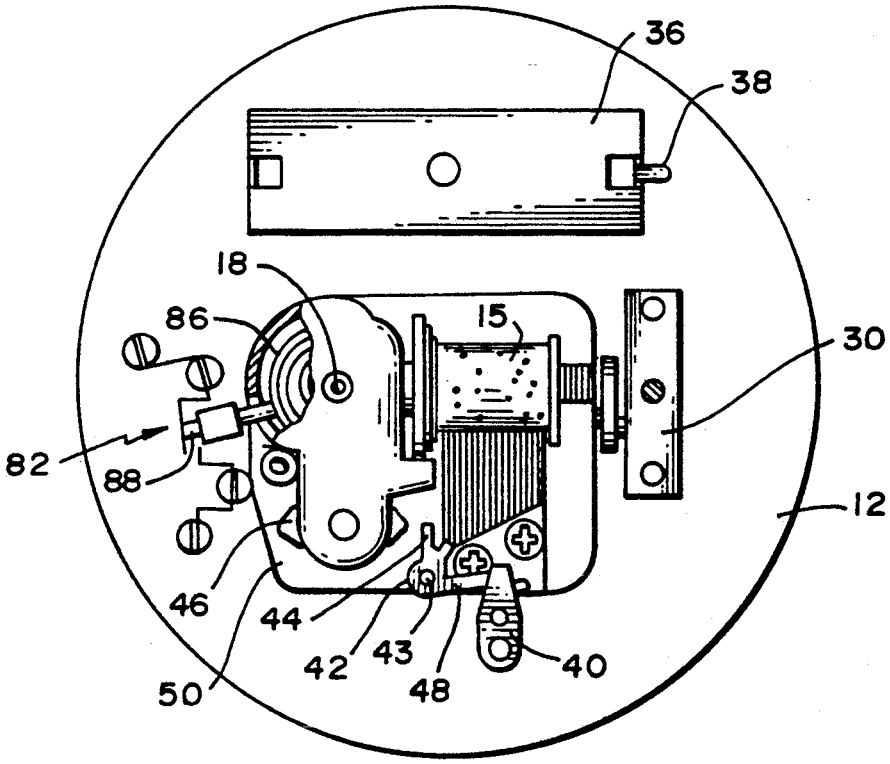

In addition to the mechanical operation described above and in the aforementioned Hou patent, the present invention includes a novel means for providing an illumination display operable only when the mechanically-driven display assembly is likewise in operation. With further reference to FIGS. 3(*a*) and 3(*b*), electrical power is provided by a battery source 34, concealed in FIG. 2 by a battery case 36. As indicated, positive current flows from an output terminal 38 to a tab 40. Tab 40 and a rotary contact 42 combine to form a switch that makes the electrical circuit only when the mechanical portion of the ornamental display assembly is activated. This is accomplished by assigning to contact 42 the dual function of mechanical switching and electrical switching.

When contact 42 is in the position shown in FIG. 3(*a*), an extension 44 of tab 42 contacts a rotating member 46 to prevent the unwinding of wind-up drive mechanism 16, as is known in the art. When contact 42 is in the position shown in FIG. 3(*b*), however, an extension 48 contacts tab 40 to provide electrical continuity for the circuit via a metal shaft 43 which is in electrical contact with a metal base 50. Since metal base 50 is in electrical contact with support rod 8 through wind-up drive mechanism 16, the circuit is thus made to allow current to flow to support rod 8, and thus to the rest of the electrical circuit, as explained below.

Figure 4A:
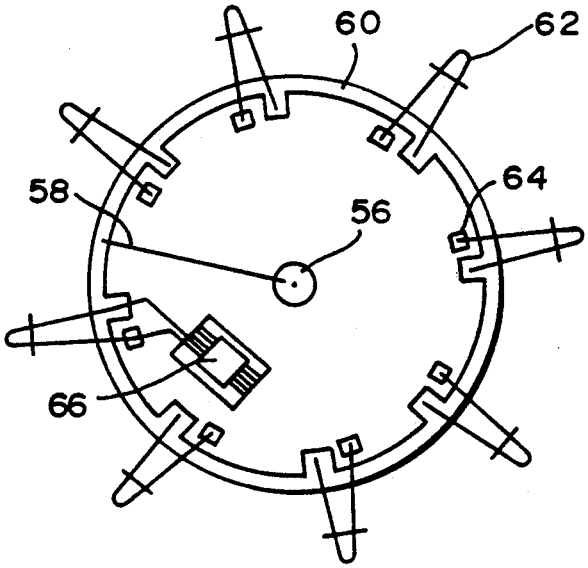
FIG. 4(*a*) illustrates the top, or obverse, side of a printed circuit board constructed according to the teachings of the present invention.
Figure 4B:
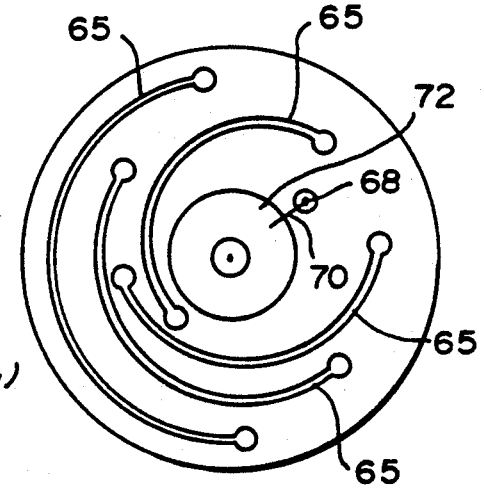

Returning to FIG. 2, and with further reference to FIG. 4(*a*), electrical current flows through support rod 8 and shaft 24 to a metal disc 52, which is illustratively integrated with shaft 24. When the invention is fully assembled, disc 52 preferably contacts the upper surface of a printed circuit board 54, and more particularly contacts a plated region 56 on the upper surface of printed circuit board 54. Electrical current then flows via a lead 58 to the perimeter of printed circuit board 54, where a plated region 60 encompasses the circumference of the upper surface of printed circuit board 54.

A plurality of light-emitting diodes (LEDs) 62 are preferably attached to the perimeter of printed circuit board 54 in radial fashion. The anode of each LED 62 is connected to the perimeter plated region 60 by any well known method, such as soldering. The cathode is likewise attached to a plated land 64 insulated from plated perimeter 60. As shown in FIG. 4(*b*), the reverse of printed circuit board 54 shows that the LEDs 62 are electrically connected in pairs by a plurality of conductive lines 65 so that, under control of a flasher element to be described, LEDs 62 burn and are extinguished in pairs. As is known, LEDs 62 are connected to the printed circuit board reverse via plated-through holes.

Returning to FIG. 4(*a*), the cathode of each LED 62, in addition to being connected to the cathode of another LED 62, is connected to one terminal of a flasher circuit designated by reference numeral 66. In an existing embodiment, flasher 66 is identified by part number HTK 205, manufactured by Her Ter of Taiwan, but may be any suitable flasher known to the art. Essentially, flasher 66 produces a periodic output signal to energize each pair of LEDs synchronously. Of course, if desired, flasher 66 may be omitted in favor of continuously burning LEDs.

The ground terminal of flasher 66 is preferably connected to ground via a plated-through hole 68 to the reverse of printed circuit board 54. A lead 70 connects through hole 68 to a plated region 72, which is electrically connected to outer sleeve 10 via a leaf contact member 74 (see FIG. 2). Leaf contact member 74 makes electrical contact to sleeve 10 by pressure contact from downward force applied to prir ted circuit board 54 via metal disc 52, threaded shaft 24 and spherical cap 26. A plurality of individual leaves 76 of leaf contact member 74 slidably contact plated region 72 as the canopy 6 and printed circuit board 54 turn, thus completing the circuit.

The ground side of the electrical circuit continues via a lug 78 and a nut 80, which secure outer sleeve 10 to cover 22, and then to one contact of a switch 82 via a wire 84 soldered or otherwise affixed to lug 78. The second contact of switch 82 is then connected to the negative terminal (not shown) of battery 34.

An important feature of the invention is illustrated in FIGS. 3(*a*) and 3(*b*). As earlier stated, FIG. 3(*a*) shows contact 42 in a first position where the electrical circuit is broken. In the FIG. 3(*a*) position, contact 42 also prevents wind-up drive mechanism 16 from operating, as is known. When contact 42 is moved into the FIG. 3(*b*) position, both the electrical circuit and wind-up drive mechanism 16 are enabled.

As is known to the art, and as described in the aforementioned Hou U.S. Pat. No. 4,890,828, wind-up drive mechanism 16 includes an internal wind-up coil 86 that expands as wind-up drive mechanism 16 unwinds. The invention takes advantage of this feature by including a plunger 88 as a means for breaking the electrical circuit at switch 82 under force from expanding coil 86.

By comparing FIG. 3(*a*) to FIG. 3(*b*), this process is readily understandable. Plunger 88 is positioned with one end extending into the housing of wind-up drive mechanism 16, and with its other end positioned adjacent to one contact of switch 82 when the coil 86 is wound. When coil 86 is fully wound, the inherent spring force of the adjacent contact biases the coil end of plunger 88 against coil 86. Alternatively, or additionally, a separate biasing means may be incorporated to bias plunger 88 inward.

As coil 86 unwinds, force exerted on the first end of plunger 88 causes the second end of plunger 88 to force the two switch contacts apart, thereby breaking the electrical circuit. By this means, when coil 86 is fully unwound (corresponding to cessation of mechanical movement), LEDs 62 will extinguish. Therefore, according to the invention, LEDs 62 will not continuously burn to extinction, nor will battery 34 run down if contact 42 is not removed from contact with tab 40 at the end of the mechanical cycle.

Figure 5:
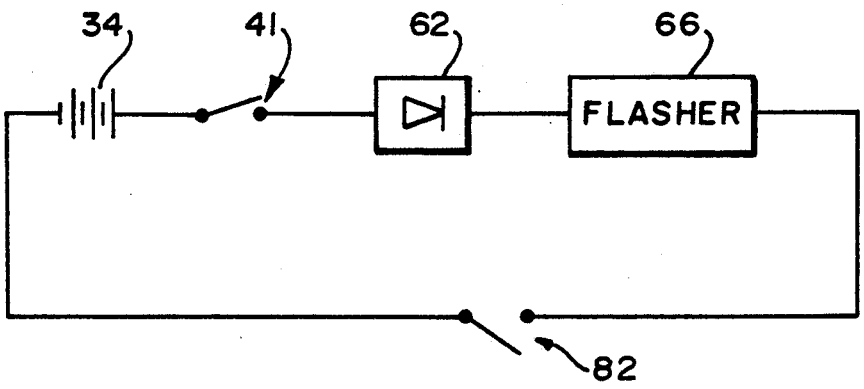
FIG. 5 illustrates a schematic of an electrical circuit designed according to the teachings of a preferred embodiment of the invention.

A schematic of the electrical circuit just described is shown in FIG. 5. Battery 34 supplies electrical power to LED array 62 via a switch 41, which corresponds to the contact made between tab 40 and contact 42. Attached to the cathodes of LEDs 62 is flasher 66, whose ground side is connected to the negative battery terminal via switch 82.

Figure 6:
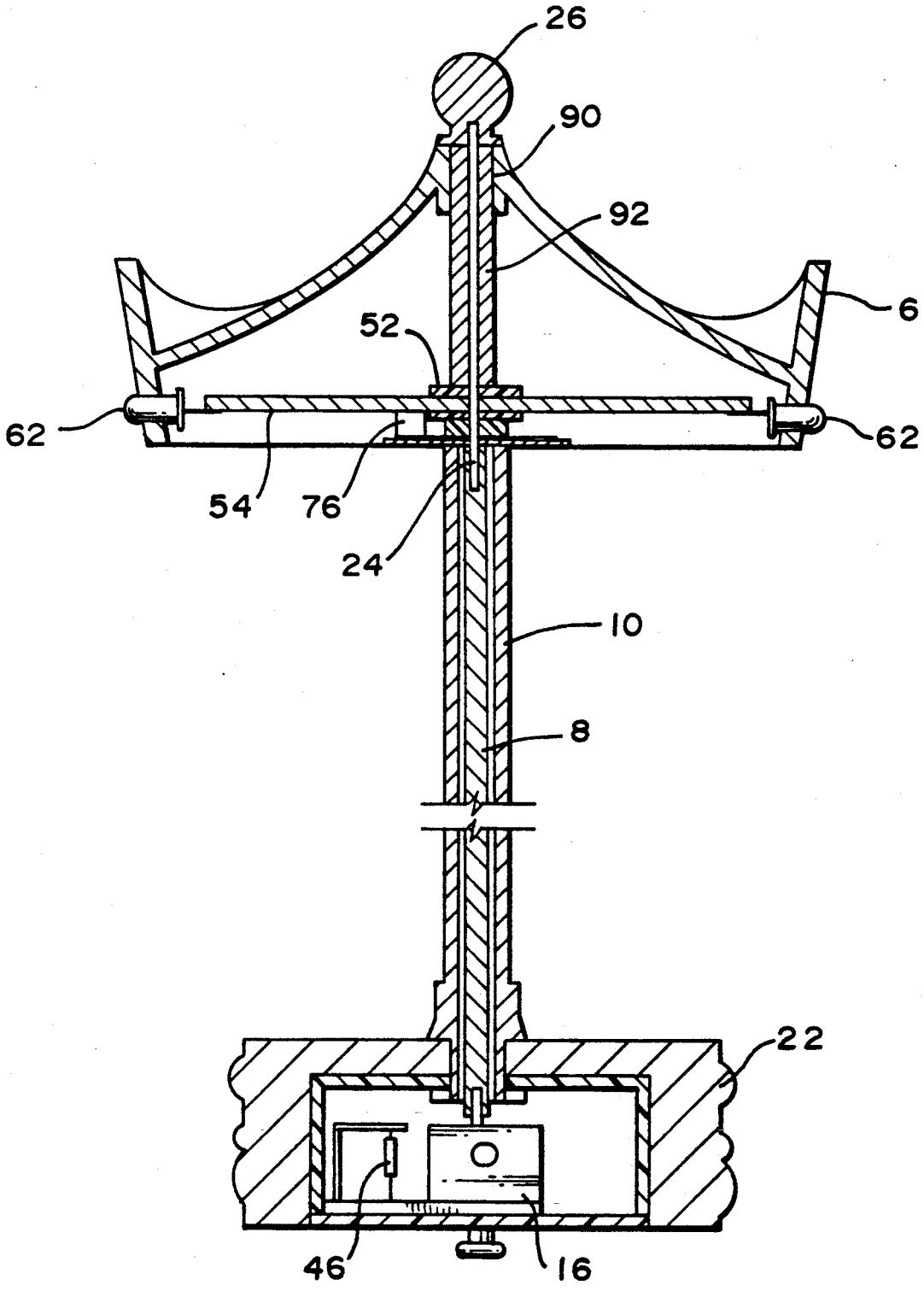
FIG. 6 illustrates a vertical cross section of a preferred improvement of the canopy drive of the present invention.

Another important aspect of the invention is described with reference to FIGS. 2 and 6. Canopy 6 is shown having a threaded shaft 24 extending through a central port 90. FIG. 2 shows threaded shaft 24 to include a rotation assist element 92 having a polygonal cross section. Central port 90 is preferably designed to have a corresponding cross section defined by mating sides to the polygon faces of element 92 to assist rotation of canopy 6 and printed circuit board 54, so that canopy 6 is not rotated simply due to contact from the rotating LEDs 62. This removes pressure on the LED leads, giving longer life to the assembly.

One of ordinary skill in the art will readily recognize that various aspects of the ornamental display assembly described in the foregoing disclosure and in the disclosure of U.S. Pat. No. 4,890,828, incorporated by reference, are not specifically set forth. For example, any appropriate resistance or other basic circuit elements that must be associated with flasher 66 are not shown for clarity. Furthermore, one of ordinary skill in the art will realize that various modifications may be made to the invention without departing from the teachings of the specifications. All such modifications that basically rely upon the teachings through which the invention has advanced the state of the art are properly considered within the spirit and scope of the invention.

I claim:

1. An ornamental display assembly comprising:

(a) a stationary portion;

(b) a movable portion supported on and movable with respect to the stationary portion;

(c) means for mechanically imparting motion to the movable portion, said means including a wind-up drive mechanism drivingly connected to the movable portion, said wind-up drive mechanism including an element movable in response to unwinding of said wind-up drive mechanism;

(d) electrically powered display means adapted to be illuminated and attached to at least one of the stationary portion and movable portion;

(e) electrical circuit means connecting the electrically powered display means to a source of electrical power, the electrical circuit means including a first switch means and a second switch means such that, when the first and second switch means are closed, the electrically powered display means are illuminated, and when either the first or second switch means is open the electrically powered display means are not illuminated; and, (f) actuating means operatively connecting the second switch means to the element movable in response to the unwinding of the wind-up drive mechanism such that, when said movable element reaches a predetermined, unwound position the second switch means is opened.

2. An ornamental display assembly as claimed in claim 1 wherein said element movable in response to unwinding of said wind-up drive mechanism comprises an expanding coil spring.

3. An ornamental display assembly as claimed in claim 2 wherein said actuating means comprises a plunger having a first end adapted to be engaged by said expanding coil spring and a second end adapted to engage said second switch means.

4. An ornamental display assembly as claimed in claim 1, wherein said movable element of said wind-up drive mechanism expands in one direction as the wind-up drive mechanism unwinds for causing said actuating means to open the second switch means to break said electrical circuit means.

5. An ornamental display assembly as claimed in claim 1, further comprising:

means for selectively starting and stopping said imparted motion, wherein said start-stop means further comprises the first switch means.

6. An ornamental display assembly as claimed in claim 1, further comprising:

a support rod rotatably engaged by said wind-up drive mechanism so that said support rod rotates about its longitudinal axis responsive to unwinding of said wind-up drive mechanism; and, a rotation assist element engaged by said support rod and said movable portion, wherein said rotation assist element has a polygonal cross section to thereby engage said movable portion for rotation with said support rod.

7. An ornamental display assembly as claimed in claim 1 wherein said electrically-powered display comprises at least one light source, and wherein said electrical circuit further includes flasher means for causing said at least one light source to flash so long as both switch means are closed and said electrical circuit is unbroken.

8. An ornamental display assembly as claimed in claim 7, wherein said at least one light source comprises a light-emitting diode.

9. An ornamental display assembly as claimed in claim 7, wherein said at least one light source comprises a plurality of light-emitting diodes, each having an anode and a cathode, all said anodes being electrically connected in common, and said cathodes being pairwise electrically connected in common so that said flasher causes the light-emitting diodes to flash in pairs.

10. An ornamental display assembly as claimed in claim 1, wherein said ornamental display assembly further comprises:

a wind-up drive mechanism including a power output shaft and a wind-up shaft housed within the stationary portion;

a first tappet rod assembly including a stationary sleeve extending upwardly from the stationary portion and a support rod rotatably housed within the sleeve, the support rod including upper and lower ends; and first attachment means for securing the movable portion on the upper end of the support rod and for permitting the movable portion and support rod to rotate together, the lower end of the support rod being secured to the wind-up shaft, whereby rotation of the support rod in one direction causes the wind-up drive mechanism to be wound, and unwinding of the mechanism causes the support rod to rotate in the opposite direction.

11. An ornamental display assembly as claimed in claim 10, further comprising circuit support means for supporting a portion of said electrical circuit including said electrically-powered display, wherein said sleeve and said support rod form part of said electrical circuit means.

12. An ornamental display assembly as claimed in claim 10, wherein the movable portion includes a canopy and further comprising a rotation assist element engaged by said support rod, wherein said rotation assist element has a polygonal cross section to thereby engage said canopy and cause rotation of the canopy with said support rod.

* * * * *